US005864891A

United States Patent [19]

Gonzales

[11] Patent Number: 5,864,891

[45] Date of Patent: Feb. 2, 1999

[54] WOMEN'S UNDER GARMENT WITH SEPARATOR PANEL

[76] Inventor: Carol L. Gonzales, 3654 Fall Creek Ct., Keizer, Oreg. 97303

[21] Appl. No.: 78,592

[22] Filed: May 13, 1998

[51] Int. Cl.[6] ..... A41B 9/04

[52] U.S. Cl. ..... 2/406; 2/408; 2/400; 2/78.1; 2/73

[58] Field of Search ..... 2/69, 73, 78.1, 2/70, 71, 211, 212, 400, 406, 407, 408; 450/100, 102

[56] References Cited

U.S. PATENT DOCUMENTS

| | | | |
|---|---|---|---|
| 1,201,860 | 10/1916 | Nelke | 2/73 |
| 1,238,686 | 8/1917 | Kimball | 2/73 |
| 1,616,440 | 2/1927 | Cohen | 2/73 |
| 1,808,614 | 6/1931 | Stein | 2/73 |
| 1,827,147 | 10/1931 | Hall | 2/73 |
| 2,506,324 | 5/1950 | Zywiecka | 2/73 |
| 2,541,698 | 2/1951 | Gulisano | 2/73 |
| 2,659,893 | 11/1953 | Hindman | 2/73 |
| 2,700,771 | 2/1955 | Fluk | 2/73 |
| 3,066,308 | 12/1962 | Erteszek | 2/73 |
| 3,399,679 | 9/1968 | Barg | 2/73 |

FOREIGN PATENT DOCUMENTS

| | | | |
|---|---|---|---|
| 957176 | 2/1950 | France | 2/73 |

*Primary Examiner*—Gloria M. Hale
*Attorney, Agent, or Firm*—Gregory T. Kavounas

[57] ABSTRACT

A special woman's under garment is provided. The under garment comprises a flexible half slip body that is worn around the waist, and covers the thighs and sometimes the knees. The under garment further comprises a flexible separator panel that is supported by the half slip body between the thighs. This way it prevents contact and thus friction of one pantyhose segment against another. Further, the panel is preferably made from friction reducing material, which thereby reduces friction between the panel and each of the pantyhose segments.

1 Claim, 2 Drawing Sheets

FIG. 4
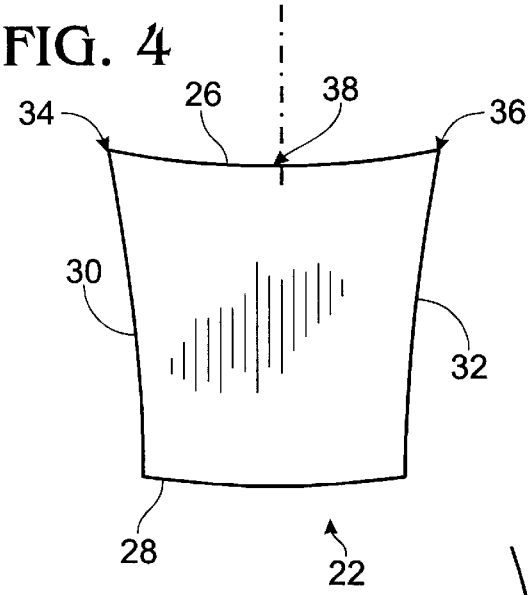
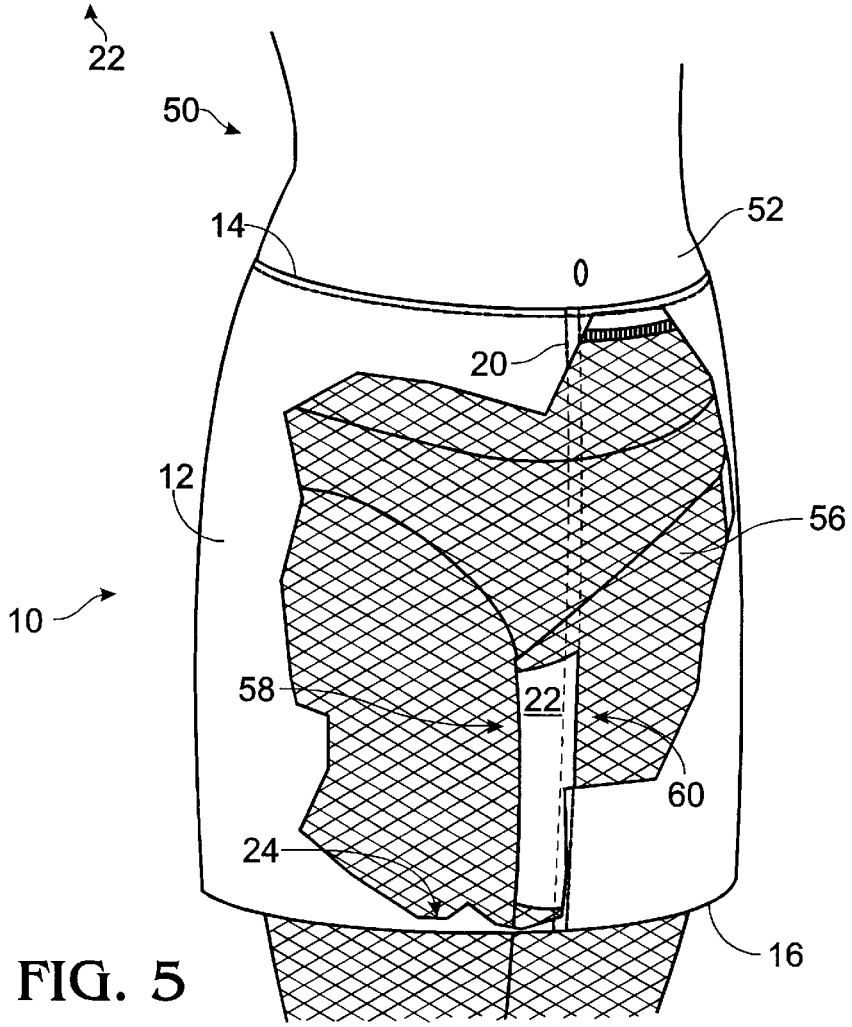
FIG. 5

WOMEN'S UNDER GARMENT WITH SEPARATOR PANEL

BACKGROUND OF THE INVENTION

1. Field of the Invention

The present invention is related to the field of women's under garments.

2. Description of the Related Art

A problem with wearing traditional half slips is that they do not stay in place, but tend to ride up as they are worn.

A problem with wearing pantyhose is that, when the thighs rub against each other, there is friction between segments of the pantyhose worn over the inner thighs and knees, which produces an embarrassing sound.

BRIEF SUMMARY OF THE INVENTION

The present invention overcomes these problems and limitations of the prior art.

Generally, the present invention provides a special woman's under garment. The under garment comprises a flexible half slip body that is worn around the waist and covers the thighs. It also covers the knees at longer lengths. The under garment further comprises a flexible separator panel that is supported by the half slip body between the thighs. This way the panel prevents the under garment from riding up as an ordinary half slip would, whether it is worn with a pantyhose or not.

When worn with pantyhose, the panel prevents chafing. It also prevents contact and thus friction of one pantyhose segment against another. Further, the panel is preferably made from friction reducing material, which thereby prevents friction between the panel and each of the pantyhose segments.

These and other features and advantages of the present invention will become apparent and more appreciated after consideration of the Drawing(s) and Detailed Description of the Preferred Embodiment(s) of the invention.

BRIEF DESCRIPTION OF THE SEVERAL VIEWS OF THE DRAWING

FIG. 4 illustrates the separator panel of a FIG. 3 shown artificially without the half slip body for clarity.

FIG. 5 illustrates a person wearing an under garment that is made according to the invention and shown as shown in FIG. 3 above.

DETAILED DESCRIPTION OF THE PREFERRED EMBODIMENT(S) OF THE INVENTION

As has been mentioned, the present invention provides a special woman's under garment. The under garment is now described with reference to FIGS. 1–4.

Figure 1:
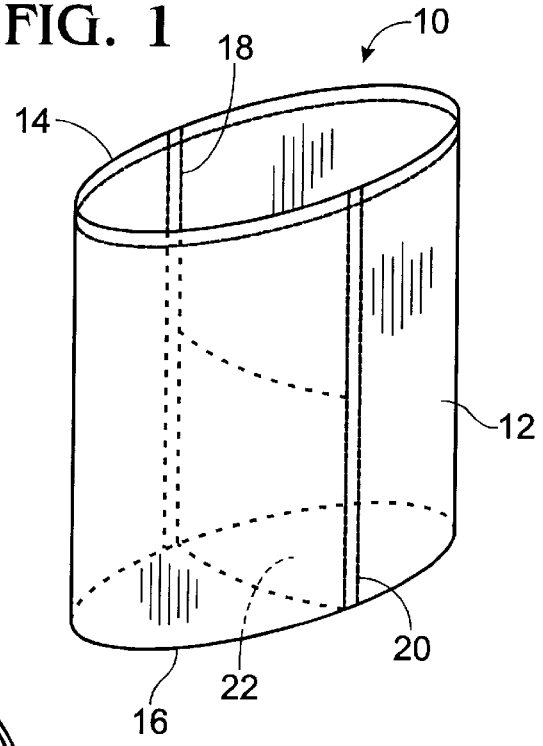
FIG. 1 is a perspective view of an under garment made according to the invention.

FIG. 1 shows an under garment 10 made according to the invention. The under garment includes a flexible half slip body 12, with a top edge 14 and a bottom edge 16. The half slip body can be made as is known in the art of making half slips. It is substantially tubular, intended to surround the thighs at least in part. It can be provided in longer sizes and also surround the knees, especially where it is going to be worn with pantyhose. It can be provided in larger sizes 2X, 3X, etc. for fuller figures. A maternity version can include an expandable elastic inset in the front of the tummy to accommodate growth in the event of pregnancy. It can include a slit in the back (which can also be turned to the front for wearing).

Figure 2:
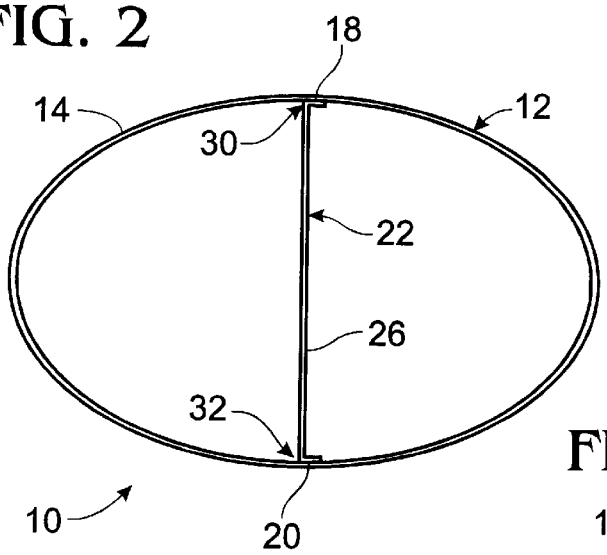
FIG. 2 is a top view of the under garment of FIG. 1.
Figure 3:
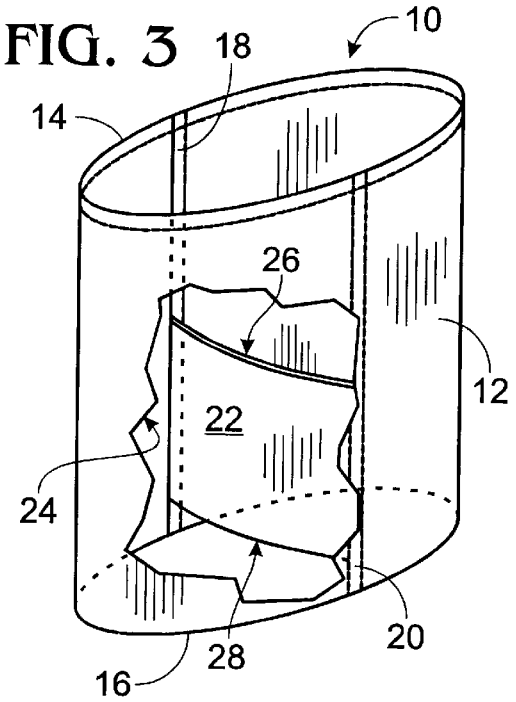
FIG. 3 is the same view as FIG. 1, but after a segment has been artificially cut out of the half slip body for clarity.

The top edge typically includes an expandable elastic band. When in its normally contracted state, the band would cause top edge 14 to have a smaller perimeter than bottom edge 16. In FIGS. 1–3 any elastic band is shown stretched so that the perimeters are equal.

The elastic band is for supporting the half slip body around the waist of a woman, such that the half slip body surrounds also the thighs at least in part. However, the half slip body can be provided as part of a skirt, permanently (by sewing) or detachably (with hooks and fasteners). In that case the half slip body is still supported around the waist indirectly when the skirt is worn.

Half slip body 12 of the invention preferably has two diametrically opposed seams 18, 20. The seams are preferably full length, i.e. they run from the top edge to the bottom edge.

Further, under garment 10 includes a novel separator panel 22. Panel 22 is supported in the inside of the half slip body as shown in FIGS. 1–3. In FIG. 3, the undergarment is shown after having artificially removed a cutout from the half slip body around jagged edge 24. This is done to illustrate better how the panel is supported by the half slip body.

It is economical as well as aesthetically pleasing that the panel be made from the same material as the half slip body. This can be a nylon material such as nylon-tricot. The panel material can be also cotton knit. In any event, the panel material is flexible.

If cost is not the object, the material of panel 22 is friction reducing, such as 100% polyester. Such is typically imported in the U.S.A., and provided under the brand name Bell Charmese™. It can be found at Nordstrom's™ store or a like store. If the material is cotton knit, the panel is made preferably not including the ribbing that is typically produced from knitting. If the material is provided with only one side that is friction reducing, then the panel can be made by overlaying two segments of material side by side such that a friction reducing side is presented on each side of the panel.

Separator panel 22 is now described in more detail with reference to FIG. 4, where it is shown by itself as is suspended by the half slip body, when the latter is suspended from its top edge 14. The panel has a top edge 26 and a bottom edge 28. Bottom edge 28 is preferably less than half as long as bottom edge 16 of the slip body. The panel also has two vertical side edges 30, 32.

The shape of panel 22 is preferably made to follow the applicable dimensions of the body of the wearer. This means that the panel is wider at the top than at the bottom. In other words top edge 26 is longer than bottom edge 28.

The panel is preferably supported onto the half slip body by sewing. Vertical side edges 30, 32 of the panel can be sewn on two distinct locations. Preferably the locations are seams 18, 20. Sewing is such that top edge 26 of the panel is below top edge 14 of the half slip body. How far below is determined by considerations of comfort, size and accommodation. The panel is the most effective when the top edge is right at the crotch of the wearer.

When the under garment of the invention is worn (as is described below with reference to FIG. 5), the panel becomes suspended by the half slip body. When suspended this way, each of side edges 30, 32 defines a peak point 34, 36 respectively. Because of the suspension, top edge 26 of the panel sags at middle point 38 with respect to peak points 34, 36. Preferably the sag is by about 1 In addition, bottom edge 28 is preferably disposed higher than bottom edge 16 of the half slip body for concealment. If the half slip body is long enough to cover also the knees, the panel is long enough to reach mid-knee.

FIG. 5 shows how a person 50 is to wear special under garment 10 of the invention instead of an ordinary slip. The person has a waist 52, and wears pantyhose 56. Under garment 10 is worn with top edge 14 on waist 52, and in such a way that half slip body 12 surrounds the thighs and supports panel 22 between them. Specifically, panel 22 is supported between a first segment 58 of the pantyhose over the right inner thigh, and a second segment 60 of the pantyhose over the left inner thigh. Segment 60 is denoted but not shown distinctly in FIG. 5, because it is obstructed by panel 22. This way panel 22 prevents contact between the segments. By being friction reducing, the panel reduces friction between itself and each of segments 58, 60. (In FIG. 5 the bottom edge of the half slip body is shown having a larger perimeter for clarity.)

Further, the under garment of the invention can be provided in different sizes and lengths as required. An under garment of a different size is made by using a half slip body and a panel of accordingly different sizes and lengths.

Although the present invention was described in detail as being worn by women, such was by example and not by limitation. The present invention covers any person who wears pantyhose.

In the present description numerous details have been set forth in order to provide a more thorough understanding of the present invention. It will be obvious, however, to one skilled in the art that the present invention may be practiced without these specific details. In other instances, well known features have not been described in detail in order to not obscure unnecessarily the present invention.

The invention claimed is:

1. For use by a person wearing pantyhose over their thighs, an under garment for preventing contact between a first segment of the pantyhose over the right inner thigh and a second segment of the pantyhose over the left inner thigh, the under garment comprising:

a flexible, substantially tubular half slip body defining a top edge and a bottom edge, the half slip body supported around the person's waist such that the half slip body surrounds the person's thighs at least in part, the half slip body including two distinct seams running from the top edge to the bottom edge; and a flexible separator panel attached to the half slip body such that the panel is supported between the first and second pantyhose segments, the separator panel having two vertical side edges and being attached to the half slip body by sewing the vertical side edges onto the seams.

* * * * *